United States Patent [19]

Amra et al.

[11] Patent Number: 4,940,384

[45] Date of Patent: Jul. 10, 1990

[54] MOLTEN METAL PUMP WITH FILTER

[75] Inventors: Lutfi H. Amra, Cleveland Hts.; Thomas M. Byrne, Jr., Cleveland; Harvey Martin, Solon; George S. Mordue, Ravenna; David V. Neff, Euclid, all of Ohio

[73] Assignee: The Carborundum Company, Niagra Falls, N.Y.

[21] Appl. No.: 309,613

[22] Filed: Feb. 10, 1989

[51] Int. Cl.[5] ..... F04D 29/70

[52] U.S. Cl. ..... 415/121.2; 75/407; 266/227

[58] Field of Search ..... 415/121.2; 266/227; 75/68 R, 93 R

[56] References Cited

U.S. PATENT DOCUMENTS

| | | | |
|---|---|---|---|
| 2,808,782 | 10/1957 | Thompson et al. | 415/121.2 |
| 3,289,473 | 12/1966 | Sweeney et al. | 415/88 |
| 4,456,424 | 6/1984 | Araoka | 415/121.2 |
| 4,504,392 | 3/1985 | Groteke | 266/227 |
| 4,743,428 | 5/1988 | McRae et al. | 75/93 R |
| 4,786,230 | 11/1988 | Thut | 415/121.2 |

*Primary Examiner*—Robert E. Garrett
*Assistant Examiner*—John T. Kwon
*Attorney, Agent, or Firm*—Weston, Hurd, Fallon, Paisley & Howley

[57] ABSTRACT

A molten metal pump includes a filter that prevents ingestion of foreign material such as dross from molten metal within which the pump is immersed. The filter is a large structure that is secured to the base of the pump surrounding the pump's inlet. The filter forms a cavity adjacent the pump's inlet. The ratio of the surface area of the filter to the inlet area of the pump is very large; the filter has a low porosity while maintaining a high flow rate for the pump.

19 Claims, 3 Drawing Sheets

MOLTEN METAL PUMP WITH FILTER

BACKGROUND OF THE INVENTION

1. Field of the Invention

The invention relates to molten metal pumps and, more particularly, to a molten metal pump having an attached filter.

2. Description of the Prior Art

In the course of processing molten metal, it often is necessary to transfer the molten metal from one vessel to another or to circulate the molten metal within a given vessel. Molten metal pumps commonly are used for these purposes. The pumps also can be used for other purposes, such as to inject purifying gases into the molten metal being pumped. A variety of pumps as described are available from Metaullics Systems, 31935 Aurora Road, Solon, Ohio 44139, under the Model designation M12 et al.

In the particular case where molten metal is melted in a reverberatory furnace, the furnace is provided with an external well in which a pump is disposed. The pump draws molten metal from the furnace and either circulates the molten metal through the external well (from which it is reintroduced into the furnace), or it transfers the molten metal out of the well to another vessel. Typically, a thermocouple will be placed in the well in order to feed back the temperature of the molten metal to the furnace for appropriate control of the furnace.

A problem with the foregoing arrangement is that foreign material such as dross, solids, or semi-solids (hereinafter referred to as "particles") contained in the well can be drawn into the molten metal pump. If large particles are drawn into the pump, the pump can be jammed, causing catastrophic failure of the pump. Even if catastrophic failure does not occur, the particles can degrade the performance of the pump or negatively affect the quality of a casting made from the molten metal. In view of the drawbacks associated with unfiltered molten metal pumps, it has become desirable to attempt to remove the particles in some manner.

One approach that has been attempted is a so-called gate filter. A gate filter is a porous barrier that is interposed between the furnace and the external well immediately upstream of the pump. In theory, a gate filter will remove particles being circulated out of the furnace, thereby avoiding ingestion of those particles into the pump. In practice, several difficulties have arisen. First, it has been found difficult to install the filter, in part because a frame must be provided for the filter at the junction between the furnace and the well. Second, the filter tends to be lifted by the molten metal, thereby permitting particles to flow into the well underneath the raised filter. Third, a thermal gradient can exist in the metal across the filter from the "hot" side to the "cold" side. The temperature of the molten metal in the well can be lower than the temperature in the furnace on the order of 50°-75° F. Because the temperature sensor for the furnace often is located in the well, the lowering of the temperature of the molten metal in the well causes the control system for the furnace to unnecessarily activate the combustion system for the furnace. In turn, excessive heat generated by the furnace causes even more particles to be formed.

Another approach that has been attempted is to suspend the pump within a liquid-permeable filter basket. In effect, the basket acts as a filter for the pump. A drawback of the basket approach is that it is difficult to properly position the pump relative to the basket. The basket must be rested on, or adjacent to, the floor of the well, and the pump must be properly suspended within the basket. Additionally, the basket must be relatively large in order to extend completely above the upper surface of the molten metal. Because the basket extends out of the molten metal, it must be insulated in some manner in order to minimize heat losses through the upper surface. Also, because the basket is so large, its cost is greater than desired.

In view of the approaches that have been described, there remains a need for an effective technique for filtering molten metal being passed through a molten metal pump. It is hoped that any such technique would be inexpensive, easy to work with, and would avoid the drawbacks of the approaches described above.

SUMMARY OF THE INVENTION

The present invention provides a new and improved technique for filtering molten metal being pumped by a molten metal pump. The invention includes a filter that is attached to the base of the pump so as to surround the inlet of the pump. Preferably, the filter is made of a porous, bonded (fired or sintered), refractory substance such as silicon carbide and/or alumina. The surface area of the filter is quite large relative to the inlet area of the pump. Due to the configuration of the filter, a large cavity is created, which cavity is defined by the interior of the filter and the bottom surface of the pump.

Due to the configuration of the filter and its relationship to the pump, the filter can have a very low porosity, for example, approximately 35-38%. The filter not only filters coarse particles that can ruin the pump, but it also filters fine particles that can negatively affect a casting. The filter according to the invention can be cleaned easily and, when cleaning no longer is feasible, it can be removed and replaced without difficulty. The compactness of the filter minimizes installation difficulties, and it also minimizes the expense of the filter.

The foregoing and other features and advantages of the invention are illustrated in the accompanying drawings and are described in more detail in the specification and claims that follow.

DESCRIPTION OF THE PREFERRED EMBODIMENT

Figure 1:
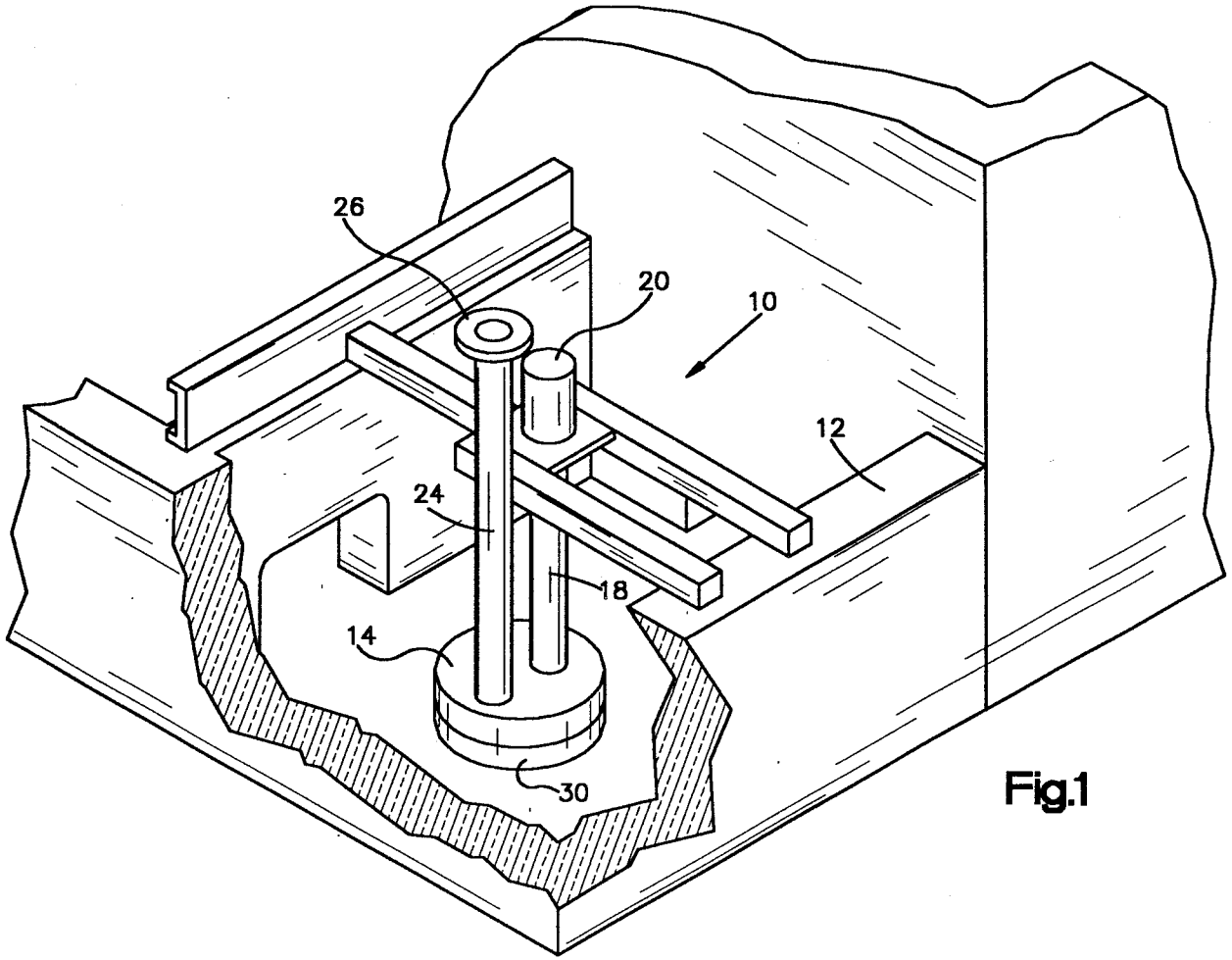
FIG. 1 is a schematic, perspective view of the external well of a reverberatory furnace into which a molten metal pump has been immersed.
Figure 2:
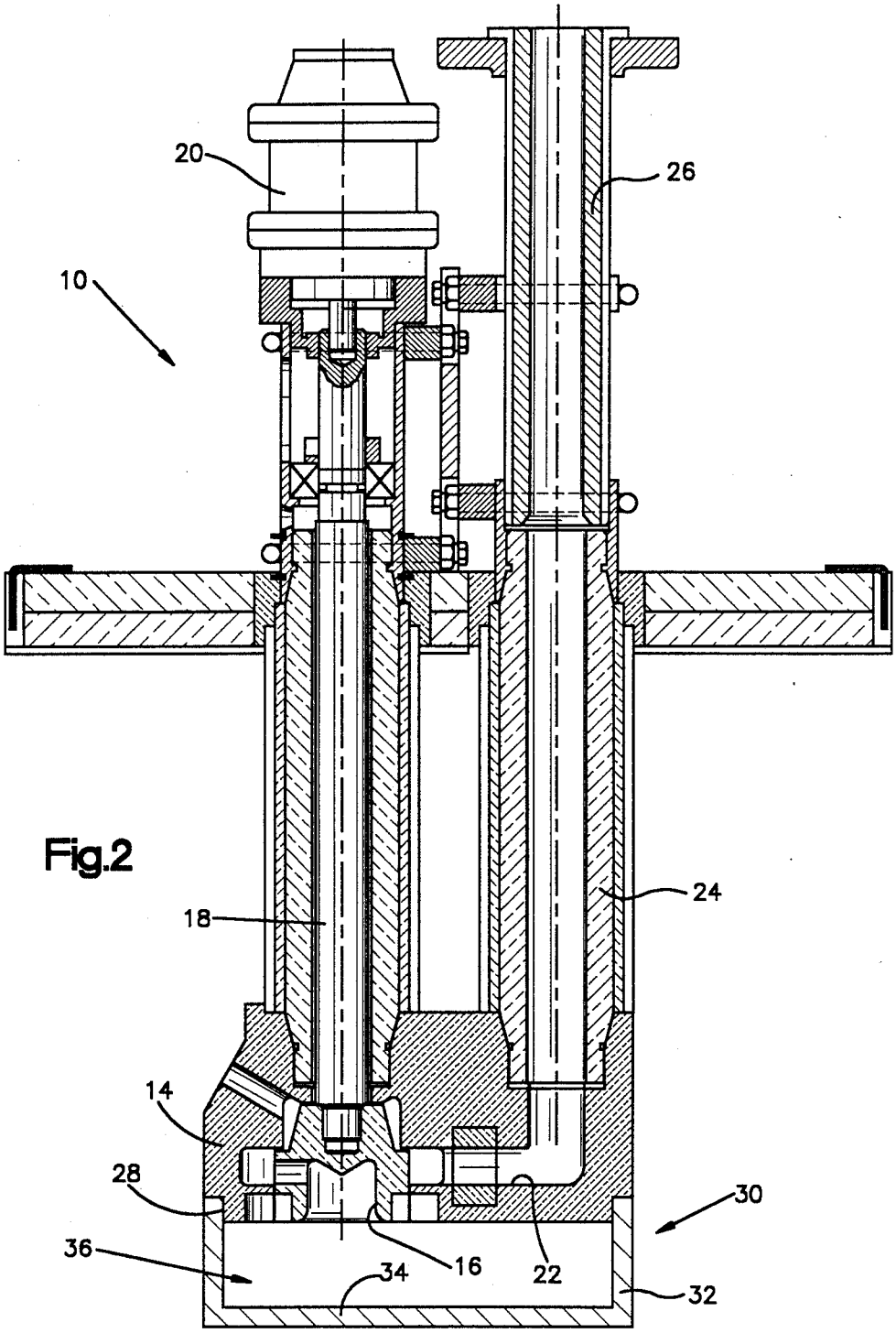
FIG. 2 is a cross-sectional view of the pump of FIG. 1.

Referring to FIGS. 1-4, a molten metal pump according to the invention is indicated generally by the reference numeral 10. The pump 10 is adapted to be immersed in molten metal contained within a vessel 12. The vessel 12 can be any container containing molten metal, although it is expected that the vessel 12 as illustrated is the external well of a reverberatory furnace.

It is to be understood that the pump 10 can be any type of pump suitable for pumping molten metal. Generally, however, and as particularly shown in FIGS. 2 and 3, the pump will have a base member 14 within which an impeller 16 is disposed. The impeller 16 is disposed adjacent the fluid rotation within the base member 14 by means of an elongate, rotatable shaft 18. The upper end of the shaft 18 is connected to a motor 20. The motor 20 can be of any desired type, although an air motor is illustrated.

The base member 14 includes an outlet passageway 22. A riser 24 is connected to the base member 14 in fluid communication with the passageway 22. A flanged pipe 26 is connected to the upper end of the riser 24 for discharging molten metal into a spout or other conduit (not shown). The pump 10 thus described is a so-called transfer pump, that is, it transfers molten metal from the vessel 12 to a location outside of the vessel 12. As indicated earlier, however, the pump 10 is described for illustrative purposes and it is to be understood that the pump 10 can be of any type suitable for the pumping of molten metal.

Figure 3:
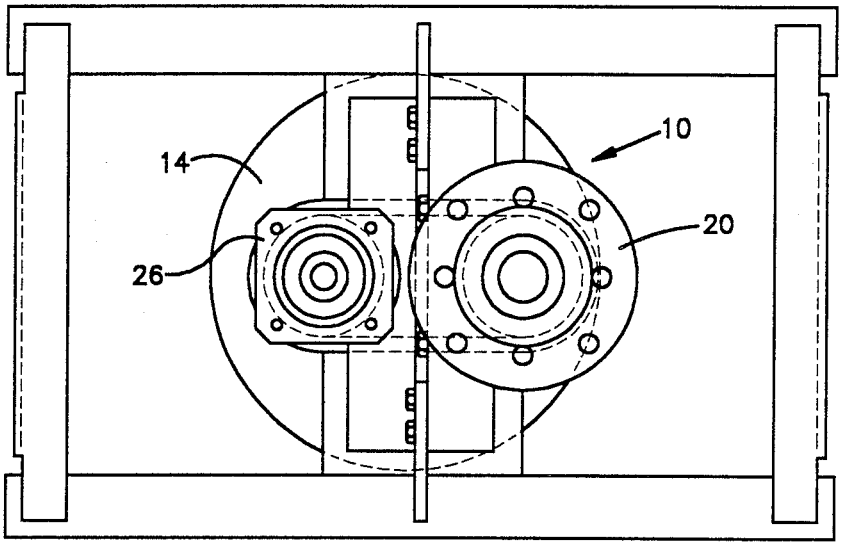
FIG. 3 is a top plan view of the pump of FIG.
Figure 4:
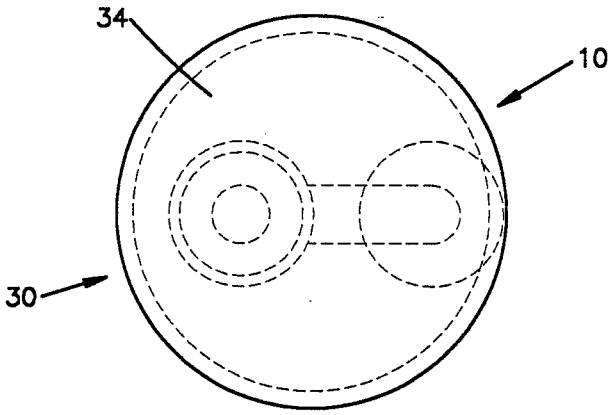
FIG. 4 is a bottom plan view of the pump of FIG. 1.

The base member 14 includes a shoulder portion 28 about its lower periphery. The shoulder portion 28 circumscribes the fluid inlet defined by the impeller 16. Referring particularly to FIGS. 3 and 4, the base member 14 is circular in plan view and, thus, the shoulder portion 28 is circular. If the base member 14 were to be of a noncircular cross-section, then the shoulder portion 28 should conform to the shape of the base member 14.

A generally cylindrical, cup-like filter 30 is connected to the base member 14 so as to completely surround the fluid inlet. The filter 30 includes a cylindrical side wall 32, and a flat end wall 34. The side wall 32 is adapted to mate tightly with the shoulder portion 28, and to be secured there by means of refractory cement such as that sold under the trademark FRAXSET by Metaullics Systems of Solon, Ohio. FRAXSET refractory cement has exceptional strength and resistance to corrosion in molten aluminum and zinc applications.

It is expected that the filter 30 will be a porous structure formed of bonded or sintered particles such as 6-grit silicon carbide or alumina. A suitable filter made of 6-grit silicon carbide or alumina is commercially available from Metaullics Systems of Solon, Ohio. The filter 30, when manufactured of 6-grit silicon carbide or alumina, has a porosity of approximately 35–38%. The filter 30 is refractory due to the material from which it is made, and thus it will withstand the temperatures encountered in the processing of molten, non-ferrous metals.

The size of the filter 30 will depend upon the pumping capabilities of the pump 10. As illustrated, the side wall 32 is approximately 7.0 inches high, and the end wall 34 is approximately 14.125 inches in diameter. The side wall 32 projects approximately 6.0 inches beyond the lowermost portion of the base member 14. The filter 30 has a uniform wall thickness of approximately 1.0 inch. For the dimensions given, the filter 30 has an external surface area of about 375 square inches, and a volume of about 375 cubic inches.

The filter 30 defines a cavity 36, which cavity is bounded by the interior surfaces of the side wall 32, the end wall 34, and the bottom surface of the base member 14. The portion of the cavity 36 defined by the filter 30 has a surface area of approximately 305.75 square inches. The inlet area of the pump is approximately 4.75 square inches (as measured by the internal diameter of the impeller 16). Accordingly, the ratio of the exterior surface area of the filter to the area of the pump inlet is approximately 78.95, while the ratio of the internal surface area of the filter to the area of the pump inlet is approximately 64.35.

Using the external surface area of the filter 30 as a reference, and assuming that the molten metal being pumped has a 12-inch head, and further assuming a flow capacity of 240 pounds per minute per square foot per inch-head, the theoretical flow rate of the filter 30 is approximately 7,488 pounds per minute. In practice, the pump 10 has a flow rate with a 12-inch head of approximately 750 pounds per minute. Accordingly, the filter 30 provides a safety factor of approximately 10.

EXAMPLE

The filter 30 has been found to be exceedingly effective in use. Using a conventional time-to-fill test, the filter 30 when newly installed enabled the pump 10 to fill a 700 pound ladle in approximately 40 seconds. When the filter 30 became clogged or nearly clogged, it enabled the ladle to be filled within about 170 seconds. After removing the pump 10 from the molten metal and cleaning the exterior surface of the filter 30, the fill time was reduced again to approximately 60 seconds. Cleaning was accomplished by carefully scraping the accumulated buildup, while hot, from the exterior surface of the filter 30. The pump 10 then was reimmersed in the molten metal.

After approximately three cleanings, the filter 30 became completely clogged and was replaced. Replacement was effected by supporting the side of the base member 14 against a solid surface and thereafter striking the opposite lower edge of the filter 30 with an instrument such as a hammer. The filter 30 as well as the cemented bond between the filter 30 and the base member 14 was fractured. The filter 30 was separated, leaving the base member 14 intact. After the shoulder portion 28 was dressed by removal of the remaining cement, a new filter 30 was installed.

The present invention provides significant advantages compared with prior filtering techniques. Because the filter 30 is integral with the base member 14, the pump 10 can be positioned as desired without concern for maintaining a proper relationship between the base member 14 and the filter 30. The position of the filter 30 relative to the vessel 12 can be adjusted simply by raising or lowering the pump 10. It is expected that the end wall 34 will be positioned approximately two or three inches from the bottom of the vessel 12, although any desired spacing can be chosen.

Because the filter 30 is completely immersed within the molten metal, it does not conduct heat out of the bath as is the case with a gate filter or a basket filter. Thermal gradients often associated with gate filters are eliminated because the filter is integral with the pump and a fully open passageway is maintained between the furnace and the external well. Further, the characteristics of the filter 30 not only enable exceedingly fine as well as coarse particles to be filtered, but the permeability of the filter is such that the pump's flow capability can be maintained. Due to the particular configuration of the filter 3 and due to the material from which it is made, the filter 30 can be cleaned easily and, when replacement is necessary, the cost to the user will be less than with a gate filter or a basket filter.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A molten metal pump, comprising:

a base member, the base member having a fluid inlet; and a filter secured to the base member and defining a cavity therebetween, the filter completely surrounding the inlet, wherein the filter is made from bonded or sintered refractory material.

2. The pump of claim 1, wherein the filter material is selected from the group consisting of 6-grit silicon carbide and 6-grit alumina.

3. The pump of claim 1, wherein the filter has a porosity within the range of about 35–38%.

4. The pump of claim 1 wherein the ratio of the surface area of the filter defining the cavity to the area of the fluid inlet is approximately 64.35.

5. The pump of claim 1 wherein the filter is a cup-like structure having a side wall closed by an end wall, the filter being attached to the base member by a cemented connection at the end of the side wall opposite the end wall.

6. The pump of claim 5, wherein the filter is secured to the base member by means of a shoulder portion formed on the base member.

7. A molten metal pump, comprising:

a base member, the base member having a bottom surface defining a circular shoulder portion and including a fluid inlet circumscribed by the shoulder portion; and a filter secured to the base member by means of a cemented connection with the shoulder portion, the filter and the bottom surface of the base member defining a cavity therebetween, the filter being formed of a bonded or sintered refractory material having a porosity within the range of about 35–38%.

8. The pump of claim 7, wherein the filter is selected from the group consisting of 6-grit silicon carbide and 6-grit alumina.

9. The pump of claim 7, wherein the ratio of the surface area of the filter defining the cavity to the area of the fluid inlet is about 64.35.

10. The pump of claim 7, wherein the filter is a cup-like structure having a side wall closed by an end wall, the cemented connection between filter and the base member being made at that end of the side wall opposite the end wall.

11. A method of filtering molten metal passed through a molten metal pump having a fluid inlet, comprising the steps of:

providing a cup-like filter of bonded or sintered refractory material having a pre-determined porosity;

attaching the filter to the pump such that the filter surrounds the fluid inlet; and drawing molten metal through the filter into the fluid inlet.

12. The method of claim 11, wherein the filter is selected from the group consisting of 6-grit silicon carbide and 6-grit alumina.

13. The method of claim 11, wherein the filter has a porosity within the range of about 35–38%.

14. The method of claim 11, wherein the ratio of the surface area of the portion of the filter exposed to the fluid inlet to the area of the fluid inlet is about 64.35.

15. The method of claim 11, wherein the step of attaching is accomplished by cementing.

16. A filter for a molten metal pump, comprising:

a porous, refractory, cup-like member, the member being defined by a side wall and an end wall that closes the side wall, the side wall and the end wall creating a cavity.

17. The filter of claim 16, wherein the member has a uniform wall thickness.

18. The filter of claim 16, wherein the member is selected from the group consisting of 6-grit silicon carbide and 6-grit alumina.

19. The filter of claim 16, wherein the member has a porosity within the range of about 35–38%.

* * * * *